US006574942B1

(12) United States Patent
Heimann et al.

(10) Patent No.: US 6,574,942 B1
(45) Date of Patent: Jun. 10, 2003

(54) METHOD FOR MANUFACTURING A SUSPENSION BAG WITH SUSPENSION HOLE

(75) Inventors: Horst Heimann, Kirchheim/Teck (DE); Klaus Soltau, Reutlingen (DE)

(73) Assignee: Hugo Beck GmbH & Co. KG, Verpackungs-Maschinebau (DE)

( * ) Notice: Subject to any disclaimer, the term of this patent is extended or adjusted under 35 U.S.C. 154(b) by 0 days.

(21) Appl. No.: 09/693,573

(22) Filed: Oct. 20, 2000

(51) Int. Cl.[7] ..... B65B 9/06; B65B 29/04

(52) U.S. Cl. ..... 53/413; 53/134.1; 53/450; 53/455; 493/226; 493/926

(58) Field of Search ..... 53/413, 455, 134.1, 53/450; 493/226, 926

(56) References Cited

U.S. PATENT DOCUMENTS

| | | | | | |
|---|---|---|---|---|---|
| 2,878,849 | A | * | 3/1959 | Lingenfelter | 493/226 |
| 2,983,087 | A | * | 5/1961 | Schofield | 53/410 |
| 3,361,041 | A | * | 1/1968 | Grob | 493/226 |
| 3,513,058 | A | * | 5/1970 | Penick | 53/134.1 |
| 3,803,990 | A | * | 4/1974 | Pedersen | 493/226 |
| 4,219,988 | A | * | 9/1980 | Shanklin | 53/568 |
| 4,566,252 | A | * | 1/1986 | Watanabe | 53/413 |

FOREIGN PATENT DOCUMENTS

| | | |
|---|---|---|
| DE | 26 10 883 | 9/1977 |

* cited by examiner

*Primary Examiner*—John Sipos
(74) *Attorney, Agent, or Firm*—Bachman & LaPointe, P.C.

(57) ABSTRACT

Introduction of a reinforcement strip into the folded edge area in the method for producing a bag with introduced goods to be packaged and with a suspension with suspension hole, wherein the goods to be packaged are introduced into a foil semi-hose which is supplied transverse to the transport direction, is deflected by a deflection device, and is further transported in the transport direction together with the goods to be packaged on a transport path and is then separated from the foil hose by a transverse welding unit and simultaneously welded. A reinforcement strip is introduced into the folded edge area of the foil hose at the deflection device, the foil hose is further transported with the reinforcement strip and the introduced goods to be packaged in the transport direction, the foil hose is sealed parallel to the folding edge of the foil hose between the reinforcement strip and the goods to be packaged, the suspension hole is introduced into the foil hose in the area of the reinforcement strip, and the individual packaging bag with the introduced goods to be packaged is separated transverse to the transport direction. The method makes it possible to produce such bags with the conventional high cycle speeds of a packaging machine. Moreover, the suspension is stronger and can be used additionally as an advertisement carrier.

6 Claims, 1 Drawing Sheet

METHOD FOR MANUFACTURING A SUSPENSION BAG WITH SUSPENSION HOLE

BACKGROUND OF THE INVENTION

The present invention relates to a method for manufacturing a bag with enclosed goods to be packaged and with a suspension having a suspension hole, wherein the goods to be packaged are introduced into a foil hose which is supplied transverse to the transport direction, is deflected by a deflecting device, and is then further transported in the transport direction together with the goods to be packaged on a transport path, and is then separated from the foil hose and simultaneously welded by means of a transverse welding unit.

Such bags, so-called polybags, are generally known. They are suitable to be suspended from a hook or from rods projecting from a wall, wherein the packaged goods are arranged below the suspension within the bag. The suspension hole is usually a so-called "Euro hole", i.e., a suspension hole which is standardized within Europe.

These known bags have the disadvantage that the suspension hole, especially the "Euro hole", can easily tear because of the weight of the enclosed packaged goods.

It is an object of the present invention to propose a possibility with which such a bag can be produced with a reinforced suspension hole and, at the same time, with the high packaging speeds conventional for packaging machines.

SUMMARY OF THE INVENTION

This object is solved according to the invention by a method with the features described hereinbelow. Further advantageous embodiments are also described hereinbelow.

According to the method in accordance with the invention, a reinforcement strip is inserted into the folded edge area of the foil hose at the deflection device which is moved together with the foil hose and the filled-in goods to be packaged in the transport direction. For this purpose, the reinforcement strip is guided along the longitudinal edge of the deflection device which is known as a forming shoulder. Subsequently, the foil hose is sealed parallel to the folded edge between the reinforcement strip and the goods to be packaged, for example, by means of a sealing welding device. Subsequently, the suspension hole is formed in the foil hose in the area of the reinforcement strip and the separation of the individual packages with the introduced goods to be packaged transverse to the transport direction takes place. The formation of the suspension hole and the separation can be performed advantageously in a single process step.

With the method according to the invention, the bags are produced transverse to the transport direction so that a corresponding feeding of the goods to be packaged is also necessary.

The advantage of this method resides in that the introduction of an additional reinforcement strip into the foil semi-hose and into the complete packaging can be performed with minimal machine expenditure in a continuous process, as it is carried out in a bag forming, filling and sealing machine. Moreover, the side of the bag opposite the reinforcement can be closed either by a lateral welding device in the known manner or can be closed by a reclosing flap. In the latter case, as is known also in the prior art, the supply of the foil semi-hose is necessary in the form that the underside projects past the upper side and the still open bag, after rotation into the transport direction, is closed by means of a corresponding closing device, for example, a blower. Both variants can be used as desired and can be provided in the same packaging machine.

A further advantage resides in the produced end product which does not tear as easily in the area of the suspension because of the reinforcement and, moreover, also has an additional area for information that can be used as an advertising means. The reinforcement strip can be produced of plastic foil or of paper or cardboard materials.

BRIEF DESCRIPTION OF THE DRAWINGS

In the following, the method will be explained with the aid of the accompanying drawings, wherein.

DETAILED DESCRIPTION OF PREFERRED EMBODIMENTS

Figure 1:
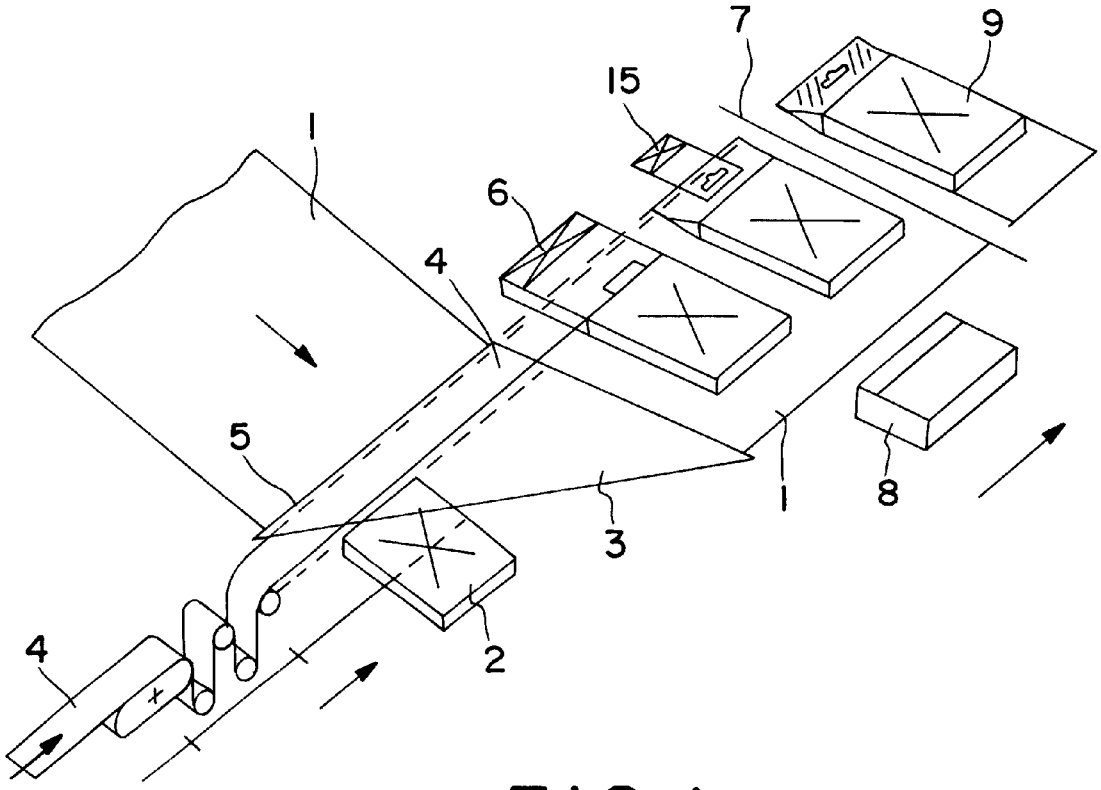
FIG. 1 shows the basic features of the present invention.

The foil semi-hose 1 is supplied transverse to the transport direction of the goods 2 to be packaged and is deflected in a manner known in the art by means of a forming shoulder 3 and then combined with the supplied goods to be packaged. The reinforcement strip 4 is introduced along the longitudinal edge 5 of the forming shoulder 3 into the foil semi-hose 1 and is thus positioned in the folded edge area of the foil hose. First, by means of a sealing welding action 6 a welding seam 14 is provided between the goods 2 to be packaged and the reinforcement strip 4. In the next step, the Euro hole welding is carried out by a welding or stamping device 15 and, at the same time, a separation of the bag by means of a transverse welding device 7 is performed. In the process sketch a lateral welding device 8 is indicated in an exemplary fashion by which the third side of the packaging bag 9 is closed.

Figure 2:
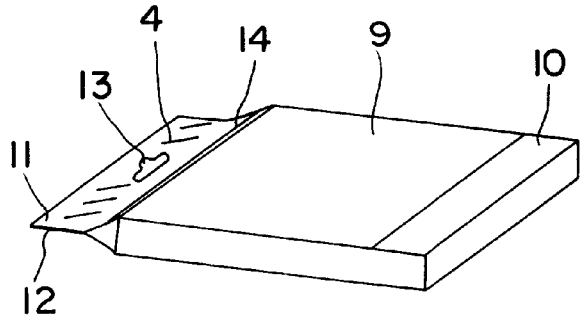
FIG. 2 shows the packaging bag with a reclosing flap produced according to the method of the present invention.

FIG. 2 shows a packaging bag 9 with introduced goods 2 to be packaged which is closed by a reclosing flap 10. In the area of the suspension the packaging bag is formed of three layers and comprises an upper and a lower foil layer as well as an interposed reinforcement strip 4 which may be printed. Between the reinforcement strip 4 and the goods 2 to be packaged a sealing welding seam 14 is arranged in order to provide the desired shape to the packaging bag and to prevent sliding of the introduced objects. In the area of the reinforcement strip 4 the suspension hole 13 the form of a Euro hole is arranged.

What is claimed is:

1. A method for manufacturing a bag with introduced goods to be packaged and a suspension hole including the steps of:

supplying a folded foil semi-hose transverse to a transport direction of said goods;

deflecting said foil semi-hose in said transport direction by a deflection device;

introducing a reinforcing strip into an edge area of said foil semi-hose at said deflection device and introducing said goods in said foil semi-hose at said deflection device;

transporting said foil hose with said reinforcement strip and said goods in said transport direction;

sealing said foil hose parallel to a folded edge of said foil semi-hose between said reinforcement strip and said goods;

forming said suspension hole through said foil hose and said reinforcement strip; and separating said foil hose and said reinforcing strip between said goods transverse to said transport direction to form a plurality of individual packaging bags.

2. The method according to claim 1, wherein the introduction of the suspension hole and the separation of the individual packaging bags are carried out simultaneously in one process step.

3. The method according to claim 1, wherein the bag is welded at the side opposite the suspension.

4. The method according to claim 1, wherein the bag is closed at the side opposite the suspension by a reclosing flap.

5. The method according to claim 2, wherein the bag is welded at the side opposite the suspension.

6. The method according to claim 2, wherein the bag is closed at the side opposite the suspension by a reclosing flap.

* * * * *

UNITED STATES PATENT AND TRADEMARK OFFICE

CERTIFICATE OF CORRECTION

PATENT NO. : 6,574,942 B1
DATED : June 10, 2003
INVENTOR(S) : Horst Heimann et al.

It is certified that error appears in the above-identified patent and that said Letters Patent is hereby corrected as shown below:

Column 1,
After line 26, -- SUMMARY OF THE INVENTION -- should be inserted.
Line 32, "SUMMARY OF THE INVENTION" should be deleted.

Column 2,
Line 57, "in" should be deleted and -- into -- should be inserted.
Line 58, the following should be inserted after "device" -- to form a folded foil with a longitudinal folded edge --.
Lines 59-60, "an edge area of said foil semi-hose" should be deleted and -- said folded foil adjacent said folded edge -- should be inserted.

Signed and Sealed this

Sixteenth Day of December, 2003

JAMES E. ROGAN
*Director of the United States Patent and Trademark Office*